US008049399B2

(12) United States Patent
Camilli

(10) Patent No.: US 8,049,399 B2
(45) Date of Patent: Nov. 1, 2011

(54) HIGH POWER DISCHARGE FUEL IGNITOR

(75) Inventor: Louis S. Camilli, Albuquerque, NM (US)

(73) Assignee: Enerpulse, Inc., Albuquerque, NM (US)

( * ) Notice: Subject to any disclaimer, the term of this patent is extended or adjusted under 35 U.S.C. 154(b) by 460 days.

(21) Appl. No.: 11/780,445

(22) Filed: Jul. 19, 2007

(65) Prior Publication Data

US 2008/0018216 A1 Jan. 24, 2008

Related U.S. Application Data

(60) Provisional application No. 60/820,031, filed on Jul. 21, 2006.

(51) Int. Cl.
*H01T 13/22* (2006.01)
*H01T 13/34* (2006.01)

(52) U.S. Cl. ..... 313/141; 313/135; 313/136; 123/596; 123/604

(58) Field of Classification Search ..... 313/141–143
See application file for complete search history.

(56) References Cited

U.S. PATENT DOCUMENTS 1,148,106 A 7/1915 Lux
2,391,458 A * 12/1945 Hensel ..... 428/655
3,267,325 A * 8/1966 Why ..... 315/53
3,683,232 A 8/1972 Baur
3,790,842 A * 2/1974 Westenkirchner et al. ... 313/118
4,419,539 A 12/1983 Arrigoni
4,460,847 A * 7/1984 Englehardt ..... 315/58
4,549,114 A 10/1985 Herden
4,568,855 A * 2/1986 Nemeth et al.
4,613,789 A * 9/1986 Herden et al.
4,746,834 A * 5/1988 Bauerle et al. ..... 313/137
4,751,430 A 6/1988 Muller et al.
5,028,747 A * 7/1991 Ballentine et al. ..... 200/19.32
5,095,242 A * 3/1992 Richeson
5,210,458 A * 5/1993 McDougal
5,272,415 A 12/1993 Griswold et al.
5,304,894 A * 4/1994 Stimson ..... 315/58
5,371,436 A 12/1994 Griswold et al.
5,514,314 A 5/1996 McDougal
5,866,972 A 2/1999 Matsubara et al.
6,130,498 A * 10/2000 Shimizu et al. ..... 313/141
6,132,277 A 10/2000 Tribble et al.
6,208,066 B1 3/2001 Kokubu et al.
6,329,743 B1 12/2001 Camilli
6,341,501 B2 * 1/2002 Sugimoto et al. ..... 65/32.2
6,517,931 B1 * 2/2003 Fu ..... 428/210
6,533,629 B1 3/2003 Boehler et al.
6,559,578 B1 5/2003 Herden et al.

(Continued)

FOREIGN PATENT DOCUMENTS

CN 2398751 Y 9/2000

(Continued)

*Primary Examiner* — Sikha Roy

(74) *Attorney, Agent, or Firm* — Jeffrey D. Myers; Justin R. Jackson; Peacock Myers, P.C.

(57) ABSTRACT

A spark-ignited, internal combustion engine ignition device to increase electrical transfer efficiency of the ignition by peaking the electrical power of the spark during the streamer phase of spark creation and improving combustion quality, incorporating an electrode design and materials to reduce electrode erosion due to high power discharge, an insulator provided with capacitive plates to peak the electrical current of the spark discharge, and concomitant methods.

17 Claims, 8 Drawing Sheets

U.S. PATENT DOCUMENTS

| | | | | |
|---|---|---|---|---|
| 6,771,009 | B2 | 8/2004 | Nishikawa et al. | |
| 6,798,125 | B2 | 9/2004 | Sugiyama et al. | |
| 6,819,030 | B2 | 11/2004 | Lipp et al. | |
| 6,864,623 | B2 * | 3/2005 | Ishikawa | 313/141 |
| 7,019,448 | B2 * | 3/2006 | McMurray et al. | 313/141 |
| 2001/0040089 | A1 * | 11/2001 | Hemingway et al. | 204/164 |
| 2004/0239223 | A1 * | 12/2004 | Watanabe | |
| 2005/0110382 | A1 * | 5/2005 | Walker, Jr. | 313/143 |
| 2005/0168121 | A1 * | 8/2005 | Tinwell | |
| 2006/0028106 | A1 * | 2/2006 | Lineton et al. | |
| 2006/0220510 | A1 * | 10/2006 | Shibata | 313/141 |
| 2007/0116976 | A1 | 5/2007 | Tan et al. | |
| 2007/0262721 | A1 | 11/2007 | Camilli | |

FOREIGN PATENT DOCUMENTS

| | | |
|---|---|---|
| GB | 937646 | 9/1963 |

* cited by examiner

HIGH POWER DISCHARGE FUEL IGNITOR

CROSS-REFERENCE TO RELATED APPLICATIONS

This application claims priority to and the benefit of the filing of U.S. Provisional Patent Application Ser. No. 60/820,031, entitled "High Power Discharge Fuel Ignitor", filed on Jul. 21, 2006, and the specification thereof is incorporated herein by reference.

BACKGROUND OF THE INVENTION

The present invention relates to spark plugs used to ignite fuel in internal combustion spark-ignited engines. Present day spark plug technology dates back to the early 1950's with no dramatic changes in design except for materials and configuration of the spark gap electrodes. These relatively new electrode materials such as platinum and iridium have been incorporated into the design to mitigate the operational erosion common to all spark plugs electrodes in an attempt to extend the useful life. While these materials will reduce electrode erosion for typical low power discharge (less than 1 ampere peak discharge current) spark plugs and perform to requirements for $10^9$ cycles, they will not withstand the high coulomb transfer of high power discharge (greater than 1 ampere peak discharge current). Additionally, there have been many attempts at creating higher capacitance in the spark plug or attaching a capacitor in parallel to existing spark plugs. While this will increase the discharge power of the spark, the designs are inefficient, complex and none deal with the accelerated erosion associated with high power discharge.

U.S. Pat. No. 3,683,232, U.S. Pat. No. 1,148,106 and U.S. Pat. No. 4,751,430 discuss employing a capacitor or condenser to increase spark power. There is no disclosure as to the electrical size of the capacitor, which would determine the power of the discharge. Additionally, if the capacitor is of large enough capacitance, the voltage drop between the ignition transformer output and the spark gap could prevent gap ionization and spark creation.

U.S. Pat. No. 4,549,114 claims to increase the energy of the main spark gap by incorporating into the body of the spark plug an auxiliary gap. The use of two spark gaps in a singular spark plug to ignite fuel in any internal combustion spark ignited engine that utilizes electronic processing to control fuel delivery and spark timing could prove fatal to the operation of the engine as the EMI/RFI emitted by the two spark gaps could cause the central processing unit to malfunction.

In U.S. Pat. No. 5,272,415, a capacitor is disclosed attached to a non-resistor spark plug. Capacitance is not disclosed and nowhere is there any mention of the electromagnetic and radio frequency interference created by the non-resistor spark plug, which if not properly shielded against EMI/RFI emissions, could cause the central processing unit to shut down or even cause permanent damage.

U.S. Pat. No. 5,514,314 discloses an increase in size of the spark by implementing a magnetic field in the area of the positive and negative electrodes of the spark plug. The invention also claims to create monolithic electrodes, integrated coils and capacitors but does not disclose the resistivity values of the monolithic conductive paths creating the various electrical components. Electrical components conductive paths are designed for resistivity values of 1.5-1.9 ohms/meter ensuring proper function. Any degradation of the paths by migration of the ceramic material inherent in the cermet ink reduces the efficacy and operation of the electrical device. In addition, there is also no mention of the voltage hold-off of the insulating medium separating oppositely charged conductive paths of the monolithic components. If standard ceramic material such as Alumina 86% is used for the spark plug insulating body, the dielectric strength, or voltage hold off is 200 volts/mil. The standard operating voltage spread for spark plugs in internal combustion spark ignited engines is from 5 Kv to 20 Kv with peaks of 40 Kv seen in late model automotive ignitions, which might not insulate the monolithic electrodes, integrated coils and capacitors against this level of voltage.

U.S. Pat. No. 5,866,972, U.S. Pat. No. 6,533,629 and U.S. Pat. No. 6,533,629 speak to the application, by various methods and means, electrodes and or electrode tips consisting of platinum, iridium or other noble metals to resist the wear associated with spark plug operation. These applications are likely not sufficient to resist the electrode wear associated with high power discharge. As the electrode wears, the voltage required to ionize the spark gap and create a spark increases. The ignition transformer or coil is limited in the amount of voltage delivered to the spark plug. The increase in spark gap due to accelerated erosion and wear could be more than the voltage available from the transformer, which could result in misfire and catalytic converter damage.

U.S. Pat. No. 6,771,009 discloses a method of preventing flashover of the spark and does not resolve issues related to electrode wear or increasing spark discharge power.

U.S. Pat. No. 6,798,125 speaks to the use of a higher heat resistance Ni-alloy as the base electrode material to which a noble metal is attached by welding. The primary claim is the Ni-based base electrode material, which ensures the integrity of the weld. The combination is said to reduce electrode erosion but does not claim to either reduce erosion in a high-power discharge condition or improve spark power.

U.S. Pat. No. 6,819,030 for a spark plug claims to reduce ground electrode temperatures but does not claim to reduce electrode erosion or improve spark power.

BRIEF SUMMARY OF THE INVENTION

The present invention provides an ignitor for spark ignited internal combustion engines, which ignitor comprises a capacitive element integral to the insulator for the purpose of increasing the electrical current and thereby power of the spark during the streamer phase of the spark event. The additional increase in spark power creates a larger flame kernel and ensures consistent ignition relative to crank angle, cycle-to-cycle. With circuitry properly employed, there is no change to the breakdown voltage of the spark gap, no change to the timing of the spark event, nor is there any change to total spark duration.

In operation, the ignition pulse is exposed to the spark gap and the capacitor simultaneously as the capacitor is connected in parallel to the circuit. As the coil rises inductively in voltage to overcome the resistance in the spark gap, energy is stored in the capacitor as the resistance in the capacitor is less than the resistance in the spark gap. Once resistance is overcome in the spark gap through ionization, there is a reversal in resistance between the spark gap and the capacitor, which triggers the capacitor to discharge the stored energy very quickly, between 1-10 nanoseconds, across the spark gap, peaking the current and therefore the peak power of the spark.

Preferably, the capacitor charges to the voltage level required to breakdown the spark gap. As engine load increases, vacuum decreases, increasing the air pressure at the spark gap. As pressure increases, the voltage required to break down the spark increases, causing the capacitor to charge to a higher voltage. The resulting discharge is peaked to a higher power value. Preferably, there is no delay in the timing event as the capacitor is charging simultaneously with the rise in voltage of the coil.

The capacitive elements preferably comprise two oppositely charged cylindrical plates, molecularly bonded to the inside and outside diameter of the insulator. The plates are formed by spraying, pad printing, rolling dipping or other conventional application method, a conductive ink such as silver or a silver/platinum alloy on the inside and outside diameter of the insulator. The inside diameter of the insulator is preferably substantially covered with ink. The outside diameter is covered except for a predetermined distance, such as 12.5 mm of the end of the coil terminal end of the insulator and that portion of the insulator exposed in the combustion chamber.

The plates are preferably offset to prevent enhancing the electrical field at the termination of the negative (outside diameter) plate, which could compromise the dielectric strength of the insulator and could result in catastrophic failure of the ignitor. The electrical charge could break down the insulator at this point with the pulse going directly to ground, bypassing the spark gap and causing permanent ignitor failure.

Preferably, once the ink is applied to the insulator, the insulator is subjected to a heat source of between 750° to 900° C. such as infrared, natural gas, propane, inductive or other source capable of reliable and controllable heat. The insulator is exposed to the heat for a period of about 10 minutes to over 60 minutes depending on the formula of the noble metal ink, which evaporates the solvents and carriers and molecularly bonds the noble metals to the surface of the ceramic insulator. Once the ink is bonded to the insulator, the resistivity of the plates is identical to the resistivity of the pure metal. The resistivity determines the efficiency of the capacitor. As the resistivity increases, capacitor efficiency decreases to the point where it ceases to store energy and is no longer a capacitor. It is, therefore, imperative in the coating process to apply a contiguous noble metal plate on the inside and outside diameter of the insulator.

The insulator is preferably constructed of any alumina, other ceramic derivation, or any similar material so long as the dielectric strength of the material is sufficient to insulate against the voltages of conventional automotive ignition. Since the capacitor plates are bonded to the inside and outside surfaces of the insulator, the capacitance is calculated using a formula that includes the surface area of the opposing surfaces of the plates, the dielectric constant of the insulator and the separation of the plates. Capacitance values of the capacitor can vary from about 10 picofarads to as much as 100 picofarads dependant on the geometry of the plates, their separation and the dielectric constant of the insulating media.

The present invention also provides an ignitor for spark ignited internal combustion engines, that includes an electrode material comprised primarily of molybdenum sintered with rhenium. Sintered compound percentages can range from about 50% molybdenum and about 50% rhenium to about 75% molybdenum and about 25% rhenium. Pure molybdenum would be a very desirable electrode material due to its conductivity and density but is not a good choice for internal combustion engine applications as it oxidizes at temperatures lower than the combustion temperatures of fossil fuels. Additionally, newer engine design employs lean burn, which has a higher combustion temperature, which makes molybdenum an even less acceptable electrode material. During the oxidation process the molybdenum electrode will erode at an accelerated rate due to its volatility at oxidation temperature thereby reducing useful life. Sintering molybdenum with rhenium protects the molybdenum against the oxidation process and allows for the desired effect of reducing erosion in a high-power discharge application.

Using noble metals for electrodes, as is current industry practice to meet federal guidelines, will not survive the required mileage requirement under high spark power operation. The increased power of the discharge will increase the erosion rate of the noble metal electrode and cause misfire. In all cases of misfire, damage or destruction of the catalytic converter will occur.

While the use of the rhenium/molybdenum sintered compound will mitigate the oxidation erosion issue, the very high power of the spark discharge will still erode the electrode at a much faster rate than conventional ignition. Electrode placement in the insulator, fully embedded in the insulator with just the extreme end and only the face of the electrode exposed, takes advantage of a spark phenomena described as electron creep. When the electrode embedded in the insulator is new, spark occurs directly between the embedded electrode and the rhenium/molybdenum tip or button attached to the ground strap of the negative electrode. As the embedded electrode erodes from use under high power discharge, the electrode will begin to draw or erode away from the surface of the insulator. In this condition, electrons from the ignition pulse will emanate from the positive electrode and creep up the side of the exposed electrode cavity, jumping to the negative electrode once ionization occurs and creating a spark.

The voltage required for electrons to creep along, or ionize, the inside surface of the electrode cavity is very small. The present invention allows the electrode to erode beyond operational limits of the ignition system but maintain the breakdown voltage of a much smaller gap between the electrodes. In this fashion, the larger gap, eroded from sustained operation under high power discharge, performs like the original gap in the sense that voltage levels are not increased beyond the output voltage of the ignition system thereby preventing misfire for the required mileage.

The invention also provides a mechanism by which high power discharge is effected and radio frequency interference, generally associated with high power discharge, is suppressed. Utilizing a capacitor, connected in parallel across the spark gap, to charge to the breakdown voltage of the spark gap and then discharge very quickly during the streamer phase of the spark, will increase the power of the spark exponentially to the spark power of conventional ignition. The primary reason for this is the total resistance in the secondary circuit of the ignition.

Advances have been made in the secondary circuit of the ignition by eliminating the high voltage transmission lines between the coil and the spark plug, and by utilizing one coil per cylinder allowing for greater electrical transfer efficiency. However, there still exists significant resistance in the spark plug, which brings the transfer efficiency of the typical automotive ignition below 1%. By replacing the resistor spark plug with one of zero resistance, electrical transfer efficiency rises to approximately 10%. The greater the electrical transfer efficiency, the greater the amount of ignition energy coupled to the fuel charge, the greater the combustion efficiency, which likely requires the use of a non-resistor spark plug to enable the very high transfer efficiency. The use of a non-resistor plug, however, produces radio frequency and electromagnetic interference (RFI), which is magnified by the very hard discharge of the capacitor. This is unacceptable because RFI at these levels and frequencies is incompatible with the operation of automotive computers, which is why resistor spark plugs are universally used by the original equipment manufacturers.

The present invention also provides a circuit that includes a preferably 5 KΩ resistor that will suppress any high frequency electrical noise while not affecting the high power discharge. Critical to the suppression of RFI is the placement of the resistor in proximity to the capacitor within the secondary circuit of the ignition system. One end of the resistor is connected directly to the capacitor with the other end connected directly to the terminal, which connects to the coil in a coil-on-plug application or to the high voltage cable from the coil. In this way, the driver-load circuit has been isolated from any resistance, the driver now being the capacitor and the load being the spark gap. Once discharged, the coil pulse bypasses the capacitor and goes directly to the spark gap, as the resistance in the capacitor is greater than the resistance of the spark gap. This placement allows for the entirety of the high voltage pulse to pass through the spark gap unaffecting spark duration.

The present invention also provides a connection of the negative capacitor plate to the ground circuit. Any inductance or resistance in the capacitor connections will reduce the efficacy of the discharge resulting in reduced energy being coupled to the fuel charge. During the application of the silver or silver/platinum ink, care is made to apply a thicker coat on the insulator surface bearing against the metal shell of the ignitor. The metal shell is provided with appropriate threads to allow installation into the head of the internal combustion engine. As the head is mechanically attached to the engine block, and the engine block is connected to the negative terminal of the battery by means of a grounding strap, grounding of the negative plate of the capacitor is accomplished by the positive mechanical contact to the spark plug shell. The additional conductive material placed on the grounding surface of the insulator is essential to ensure positive mechanical contact and elimination of any resistance or impedance in the connection. This connection can be compromised during the assembly process of crimping the shell onto the insulator. The addition conductive coating assures a positive electrical connection.

The present invention also provides a connection to the positive plate of the capacitor providing a resistance free path to the center positive electrode of the ignitor. This is accomplished with the utilization of a conductive spring constructed of a steel derivative, highly conductive yet resistant to the temperature variations in an under hood installation. The spring is connected to one end of the resistor or inductor and makes positive contact directly to the positive electrode which is silver brazed to the positive plate of the capacitor.

The present invention also provides a positive gas seal for the internal components of the ignitor against gasses and pressures resulting from the combustion process. During the insulator coating process, the positive electrode is coated with the identical material used in coating the insulator except that it is in paste form. The paste is applied to the electrode which is 0.001-"0.003" undersize to the cavity in the insulator provided for the electrode.

After the insulator is coated with the silver or silver/platinum ink along substantially the entirety of the inside diameter, the paste coated electrode is placed into the cavity provided in the insulator. The insulator/electrode assembly is then heated to between 750° and 900° C., dependent on the formulation of the metal ink, holding that temperature for a period of 10 minutes to over 60 minutes, dependent on ink formulation. Once heated, the electrode is effectively silver brazed and molecularly bonded to the insulator providing the positive gas seal.

The present invention advantageously provides an ignition device having a very fine cross sectional electrode of a material and design to effectively reduce the electrode erosion prevalent in high power discharge, spark-gap devices, and an insulator constructed in such a manner as to create a capacitor in parallel with the high voltage circuit of the ignition system, and a method by which to apply a conductive coating to the inside and outside diameter of the ignitor insulator forming the oppositely charged plates of an integral capacitor. The present invention also provides for the placement of an inductor or resistor within the ignitor whereby the resistor or inductor suitably shields any electromagnetic or radio frequency emissions from the ignitor without compromising the high power discharge of the spark, and a method of completing the capacitor and high voltage circuit of the ignition system to provide a path for the high power discharge to the electrode of the ignitor.

BRIEF DESCRIPTION OF THE SEVERAL VIEWS OF THE DRAWINGS

The objects and features of the present invention will become clearer from the following description of the preferred embodiments given with reference to the attached drawings, wherein.

DETAILED DESCRIPTION OF THE INVENTION

Figure 1:
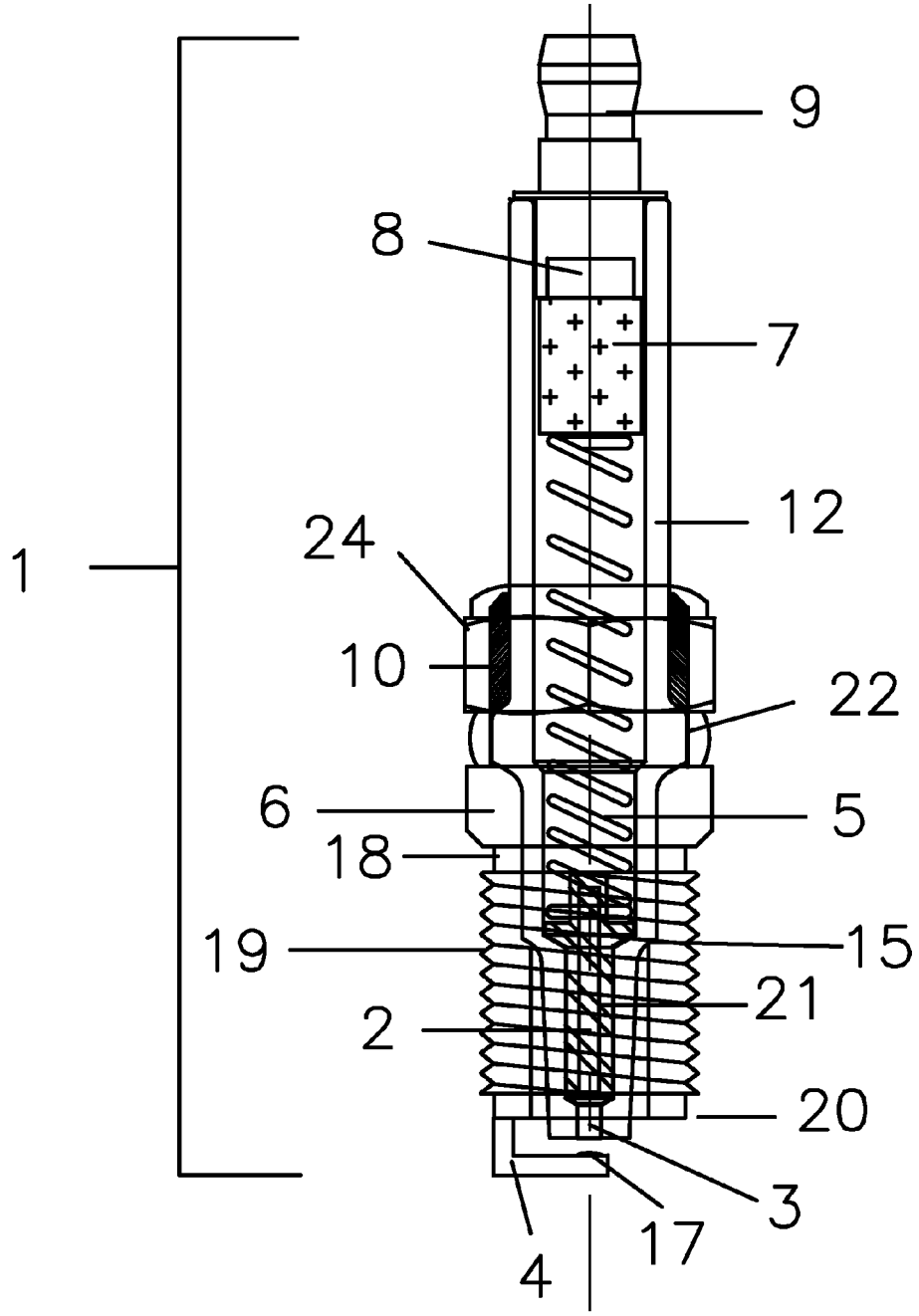
FIG. 1 is a cross sectional view of an embodiment of an ignition device for internal combustion spark ignited engines of the present invention.

Referring now to the drawings, in particular FIG. 1, a spark ignited, internal combustion engine ignition device, spark plug, or ignitor in accordance with the present invention is shown generally as 1. The ignitor 1 consists of a metal casing or shell 6 having a cylindrical base 18, which may have external threads 19, formed thereon for threading into the cylinder head (not shown) of the spark ignited internal combustion engine. The cylindrical base 18, of the ignitor shell 6 has a generally flattened surface perpendicular to the axis of the ignitor 1 to which a ground electrode 4 is affixed by conventional welding or the like. In an embodiment of the invention, the ground electrode 4 has a rounded tip 17 extending therefrom and preferably formed from a rhenium/molybdenum sintered compound, which resists the erosion of the electrode due to high power discharge, as further disclosed herein.

Ignitor 1 further includes a hollow ceramic insulator 12 disposed concentrically within the shell 6, center or positive electrode 2 disposed concentrically within the insulator 12 at the extreme end of insulator 12 that portion of which when installed extends into in the combustion chamber (not shown) of the engine. Insulator 12 is designed to maximize the opposing inside and outside surface areas to have consistent wall thickness sufficient to withstand typical ignition voltages of up to 30 Kv.

Preferably, center or positive electrode 2 includes a central core 21 constructed of a thermally and electrically conductive material with very low resistivity values such as copper a copper alloy, or similar material, with an outer coating/cladding or plating, preferably a nickel alloy or the like. The center electrode 2 is preferably affixed by weldment or other conventional means with an electrode tip 3 constructed of a rhenium/molybdenum sintered compound (25%-50% rhenium) highly resistant to erosion under high power discharge.

Ignitor 1 is further fitted with a preferably highly electrically conductive spring 5, which is a conductor disposed between one end of the preferably 5 $K_{\Omega}$ resistor or appropriate inductor 7 and the positive or center electrode 2. In an embodiment, resistor or inductor 7 is attached to the high voltage terminal 9 for the coil connection by means of a recessed cavity 8 to the copper or brass terminal 9, as further disclosed herein.

The insulator 12 of the ignitor is supported and held within the shell 6 by means of a strong metallic sleeve or crimp bushing 10, wherein the bushing 10 provides for alignment and mechanical strength to support the pressure to the major boss 22 of the insulator 12 downward to that angle where the insulator 12 contacts the shell at contact point 15 when the shell 6 is crimped with downward pressure onto the insulator 12. At contact point 15 where the insulator 12 and shell 6 would make physical contact under significant crimping pressure, a washer 23 (see FIG. 5B) constructed of a nickel or other highly conductive alloy is provided to cushion the compression pressure resulting from the crimping process and provide a gas seal against combustion pressures, as further disclosed herein.

Figure 2:
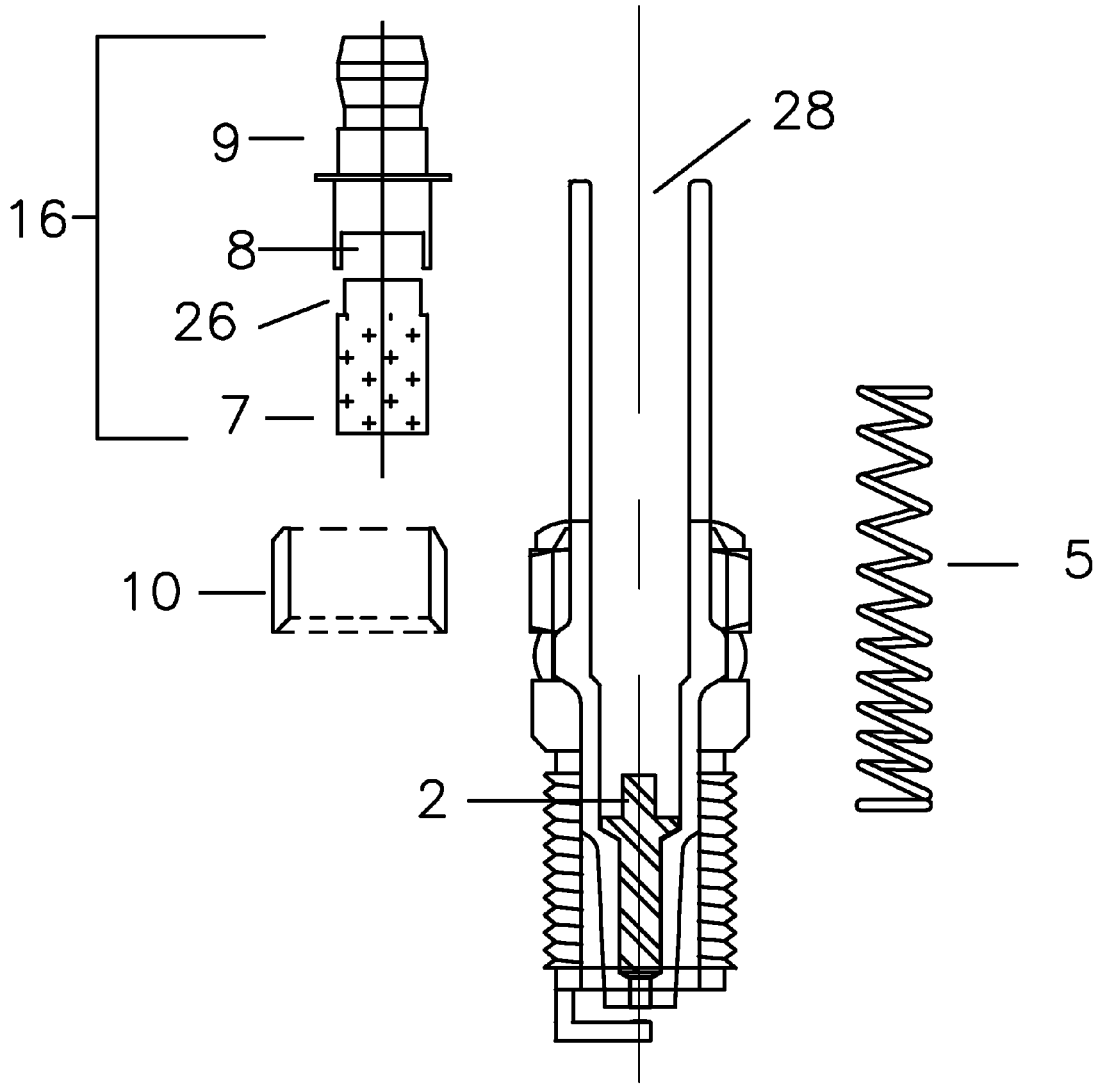
FIG. 2 is a partially exploded cross sectional view of the ignition device of FIG. 1.

Referring now to FIG. 2, there is shown the resistor or inductor 7 and the coil or high voltage cable terminal 9. Terminal 9 is constructed of any highly conductive metal. The resistor or inductor 7 may be attached to the coil terminal 9 at the provided cavity 8 by various means including high temperature conductive epoxy, threadment, interference fit, soldering or other method to permanently affix the resistor or inductor 7 to the terminal 9. The attachment between the resistor or inductor 7 and the terminal 9 must be of very low impedance and resistance and permanent. The resistor or inductor 7 permanently affixed to the terminal 9 is then inserted into the insulator cavity 28 and permanently affixed by highly conductive high-temperature epoxy or other method by which to withstand underhood automotive engine installations. Prior to installing and permanently affixing the resistor/inductor/terminal assembly 7,9,16 the conductive spring 5 in inserted into the insulator cavity 28 and compressed during the installation of the resistor/inductor/terminal 7,9,16 assemblies. Compression is required to ensure a positive mechanical and electrical contact between the center or positive electrode 2 and the end of the resistor or inductor 7. This connection is essential to the operation of the capacitive elements, which will become clearer as further disclosed herein.

Figures 3, 3A, 3B:
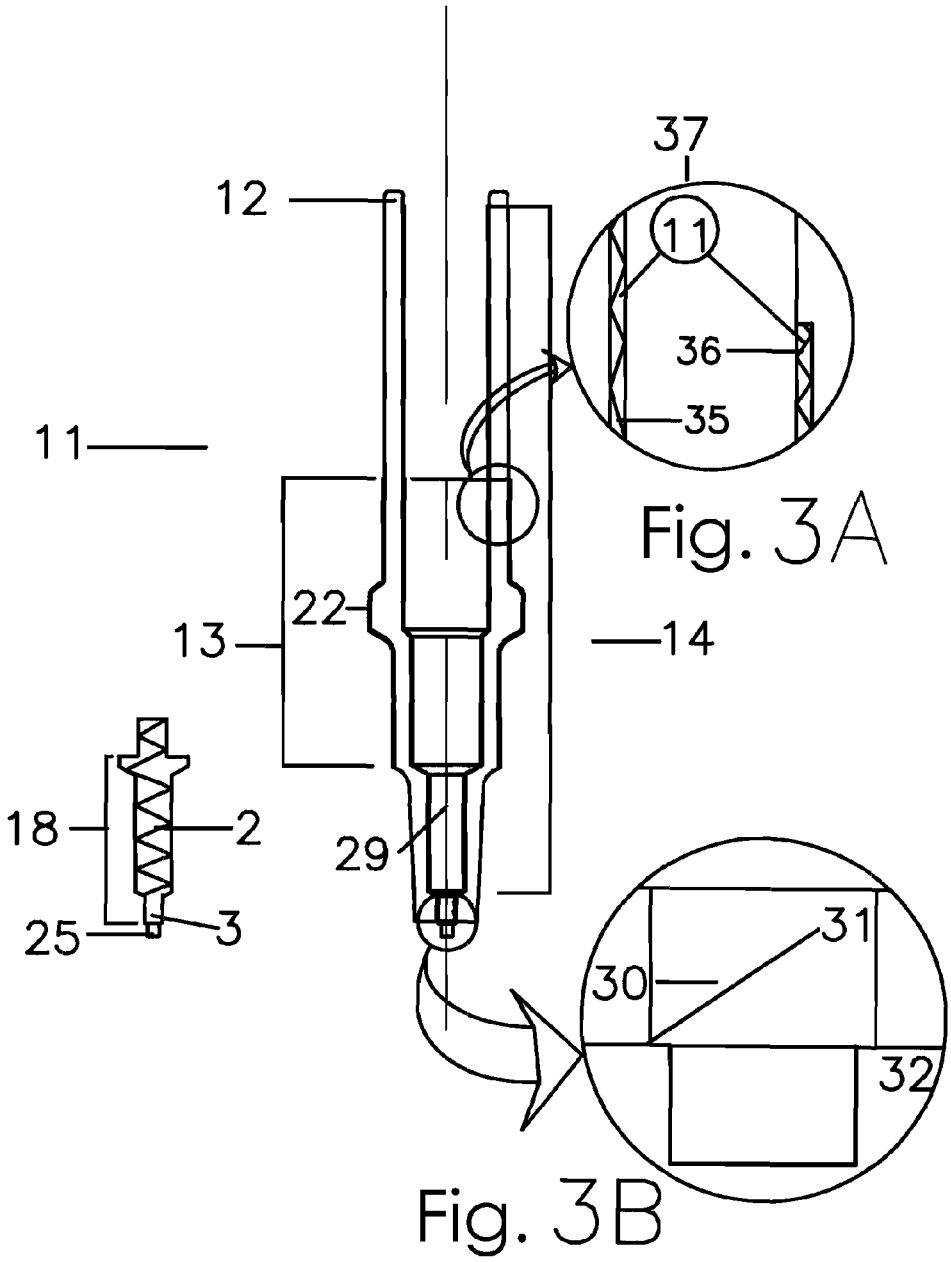
FIG. 3 is a cross sectional view of the insulator capacitor of the present invention.
FIG. 3A is a view on an enlarged scale of the encircled area of FIG. 3.
FIG. 3B is a view on an enlarged scale of the encircled area 3B of FIG. 3.

Referring now to FIG. 3, there is shown the insulator 12 and center electrode 2 with erosion resistant tip 3 separate from all other components of the ignitor 1. There is abundant prior experimentation with related results, see Society of Automotive Engineers Paper 02FFFL-204 titled "Automotive Ignition Transfer Efficiency", concerning the utilization of a current peaking capacitor wired in parallel to the high voltage circuit of the ignition system to increase the electrical transfer efficiency of the ignition and thereby couple more electrical energy to the fuel charge. By coupling more electrical energy to the fuel charge, consistent ignition relative to crank angle is accomplished reducing cycle-to-cycle variations in peak combustion pressure, which increases engine efficiency.

An additional benefit of coupling a current peaking capacitor in parallel is the resultant large robust flame kernel created at the discharge of the capacitor. The robust kernel causes more consistent ignition and more complete combustion, again resulting in greater engine performance. One of the benefits of utilizing a peaking capacitor to improve engine performance is the ability to ignite fuel in extreme lean conditions. Today modern engines are introducing more and more exhaust gas into the intake of the engine to reduce emissions and improve fuel economy. The use of the peaking capacitor will allow automobile manufacturers to lean air/fuel ratios with additional levels of exhaust gas beyond levels of current automotive ignition capability.

Referring to the insulator 12 and center electrode 2 of FIG. 3, the location of the placement of the conductive ink can be seen for the outside diameter of the insulator 13 and the inside diameter of the insulator 14. The conductive ink, silver or silver/platinum alloy, is applied by means of spraying, rolling, printing, dipping, or any other means by which to apply a consistent, solid, film on the insulator 12 on the outside diameter surface at 13 and inside diameter surface at 14. Once the ink is applied the insulator is placed in a heat source, natural gas flame, inductive, infrared or other capable of maintaining about 890° C. for a period of about sixteen minutes.

Once the silver ink has been exposed to the about 890° C. temperature for about sixteen 35 minutes, the carriers and solvents are driven off, the silver bonds molecularly to the surface of the insulator leaving a contiguous, highly conductive film of between about 0.0003"-0.0005" in thickness. The thickness is not critical as it can be as thick as about 0.001" or as thin as about 0.0001" so long as there are no breaks, gaps or incomplete coverage of the film. Assurance of the application is garnered by measuring the resistivity of the film from the extreme ends of the coverage. If pure silver film is used the resistivity of the coating should be identical to the resistivity of silver or about $1.59\times10^{8}$ ohms/meter. Another method and embodiment to the current invention of creating the positive plate of the capacitive element is further disclosed herein.

Referring again to FIG. 3 and specifically 3B, one can see a embodiment of the invention as once the silver ink has been molecularly bonded to the insulator 12, forming a silver film, the positive cylindrical plate 35 of the capacitor can be seen separated from the negative plate 36 of the capacitor by the insulator 12, forming capacitor 11.

The resistivity of the capacitor plates 35 and 36 of capacitor 11 will determine the efficiency and effectiveness of the capacitor 11. The higher the resistivity, the charge and discharge timeframe of the capacitor will be slower and a lower coupling energy will result. Now that the silver film has been converted into a highly conductive cylindrical plates 34 and 35 in coverage areas 13 and 14, capacitance measurements can be made as the insulator 12 is now a capacitor by definition, i.e., a capacitor being two conductive plates of opposite electrical charge separated by a dielectric. Capacitance can be mathematically arrived at by formula;

$$C = \frac{1{,}4122 \times D_c}{L_n(D_l / D_o)}$$

Where C is the capacitance per inch in length of cylindrical plates at coverage areas 13 and 14, $D_c$ is the dielectric constant of the insulator 12, $L_n$ is the natural log, D is the inside diameter of the negative plate (or the outside diameter of the insulator 12, at the coverage area 13, as the capacitor plates are very thin), and $D_o$ is the outside diameter of the positive plate (or the inside diameter of the insulator 12, at the coverage area 14). Capacitance can be advantageously increased by decreasing the separation of the oppositely charged plates 34 and 35 or by increasing the surface areas of the plates 34 and 35 by making coating area 13 longer along the axis of the insulator 12. Capacitance using high purity alumina can range from 10 picofarads (pf) to over 90 picofarads (pf) in a standard sized ISO sparkplug configuration dependant on the design of the insulator 12 and the placement of the capacitor plates 34 and 35.

It can be seen that the coverage area 14 of the inside diameter is more than the coverage area 13 of the outside diameter. The purpose and embodiment of the invention of offsetting these coverage areas is to spread the electric field at the extreme ends of coverage area 13. If coverage area 13 and coverage area 14 mirror each other, that is, identical length and directly opposite each other, the electrical field would be enhanced at this mirror point, multiplying the effective ignition voltage thereby compromising the dielectric strength, or voltage hold-off, of the insulator 12 resulting in the ignition pulse arcing through the insulator at that point and potentially causing a catastrophic failure of the ignitor.

Attention is now directed in FIG. 3 to the center or positive electrode 2 and the lower cavity 29 of insulator 12 into which the electrode 2 is embedded concentrically. After applying the conductive silver or silver alloy ink to the insulator 12 as above described, the electrode 2 is applied with a silver or silver alloy paste of preferably the exact same formula of the ink except that the viscosity is significantly higher. The paste is applied to the complete outside surface of the electrode 2 at the area defined 18. Once the paste is applied, the electrode is inserted into the lower cavity 29 of the insulator 12. The insulator 12, with electrode 2 inserted is then exposed to a heat source as defined above at about 890° C. for a period of no less than about sixteen minutes at this temperature. In this fashion, the electrode 2 is molecularly bonded to the inside diameter of the insulator 12 along the axis defined by 18 by the silver paste turned solid silver. As the inside diameter of the insulator 12 has been coated with silver ink along the axis defined by 14, electrical contact has been advantageously established between the electrode 2 and the positive plate 35 of the capacitor.

Another embodiment of the invention can be seen in FIG. 3 referring to the concentric placement of the center electrode 2 in the insulator cavity 29. As described herein above, the electrode 2 is molecularly bonded to the inside of the insulator 12 at the insulator cavity 29 thereby providing a gas seal against combustion pressure.

Looking again at FIG. 3 and specifically the center electrode 2 with another embodiment of the invention, the highly erosion resistive electrode tip of molybdenum/rhenium design can be seen at 3 with the pure rhenium extension at 25. Within the ignition or spark gap pulsed-power industry it is a well-known fact that increasing the power (Watts) of the spark increases the erosion rate of the electrodes, with the spark-emanating electrode eroding faster than the receiving electrode. Industry standard has been to utilize precious or noble metals such as gold, silver, platinum iridium and the like as the electrode metal of choice to abate the electrode erosion resulting from common ignition power.

These metals however will not suffice to reduce the elevated electrode erosion rate of the high power discharge of the current invention, especially since it is common practice to utilize electrode diameters of as small as 0.5 mm. An electrode tip 3 of a sintered compound of rhenium by about 25% to 50% by mass sintered with molybdenum in a cylindrical configuration of about 0.1 mm-1.5 mm in diameter and about 0.100" in length, with a pure rhenium extension 25, is affixed to the center electrode 2 by means of plasma, friction or electron welding or other method by which permanency is achieved while delivering a low resistance juncture. The use of pure rhenium as an electrode in a spark gap application is well documented within the pulsed-power industry as a very erosion resistant material although very expensive for high volume application.

Compounding rhenium with molybdenum and then isolating the molybdenum material from the oxygen present in the combustion chamber offers some protection for the molybdenum against oxidation, the bonding metal will erode during the high-power discharge process, which exposes the raw molybdenum to ambient oxygen in the combustion chamber thereby accelerating molybdenum erosion. However, the erosion rate due to oxygen exposure is significantly reduced by the use of the bonding agent. Additionally, as the molybdenum erodes, the rhenium is now closer to the opposing electrode, and as proximity and field effect dictate where the spark emanates from, the rhenium, also highly resistant to high-power erosion, becomes the source of the spark streamer.

The second part of the solution to being able to utilize molybdenum as an electrode material in an automotive application, and an embodiment of the invention, is the design of the electrode placement in the insulator cavity 29 and the complete cladding of the electrode tip 3 with the positive plate 35 of the capacitor as described herein above. In this placement, only the extreme end of the electrode tip 3 is exposed to the elements in the combustion chamber. The remainder of the cylindrical electrode tip 3 has been molecularly bonded to the insulator cavity 30 and the positive plate 35 completely sealing off the electrode tip 3 against any combustion gasses including oxygen. In this fashion only the extreme end of the electrode will erode, as it will under the high power discharge of the current invention.

As the electrode gradually wears away, electrons from the ignition pulse will emanate from the recessed electrode tip 3 and ionize the insulator wall 31 and creep to the edge of the insulator 32 before ionizing the spark gap (not shown) and creating a spark to the ground electrode (not shown). The voltage required to ionize the insulator wall 31 just above the eroding electrode tip 3 is very small resulting in the total voltage required to breakdown the spark gap and create a spark being minimally more than the voltage required to ionize the original, unerroded spark gap. Additionally, as the insulator wall 31 has been molecular bonded with silver and as the electrode is wearing away, the silver will act as an electrode further reducing the voltage required to break down (ionize) the spark gap and make a spark.

In this fashion, the electrode tip 3 can erode to the point where the distance from the ground electrode (not shown) to the center or positive electrode tip 3 has doubled while the voltage required to break down the doubled gap is slightly more than the breakdown voltage of the original spark gap and well under the available voltage from the original equipment manufacturer ignition system. This preferably assures proper operation of the engine for a minimum of $10^9$ cycles of the ignitor or 100,000 equivalent miles.

Figure 4:
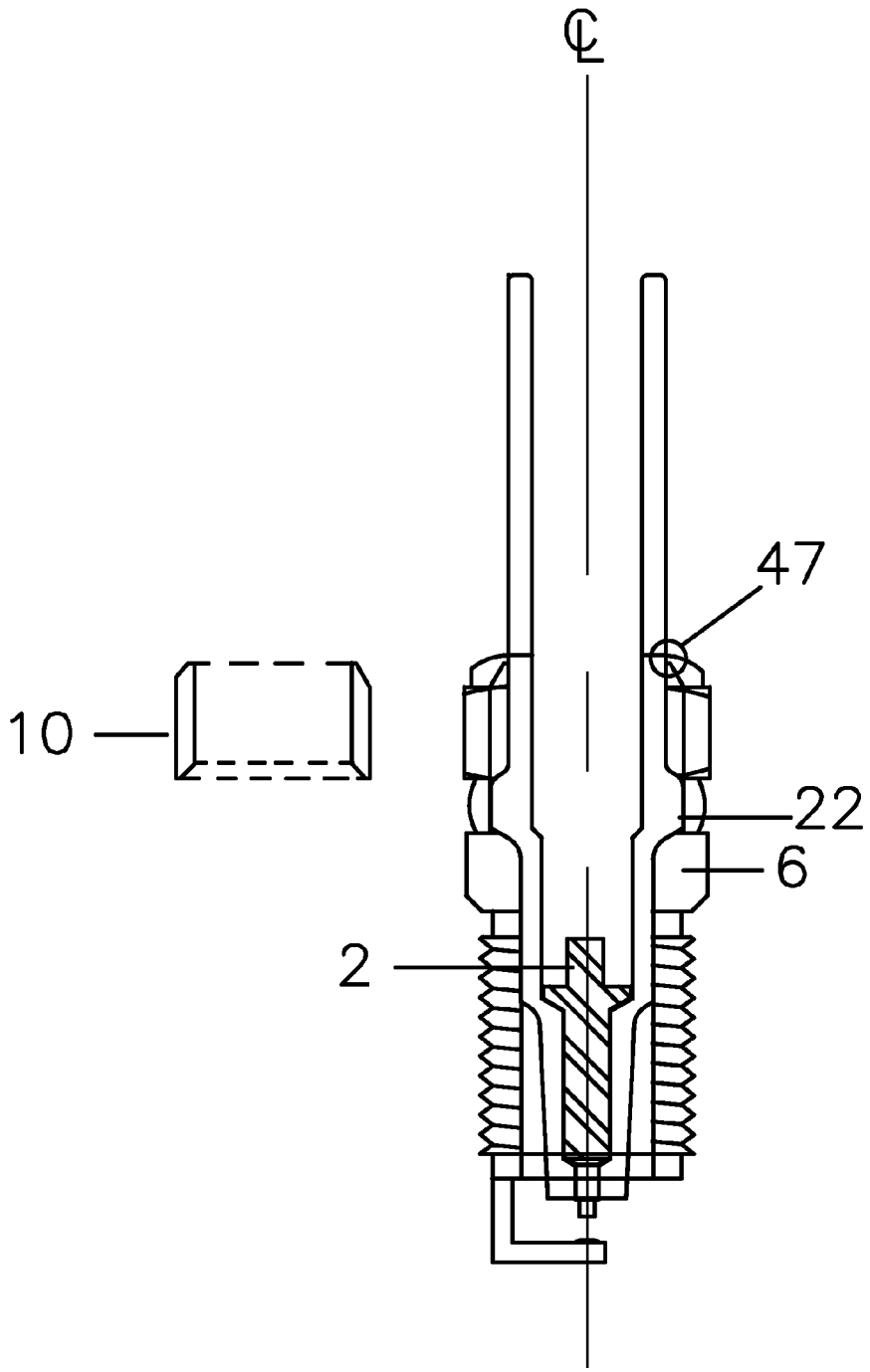
FIG. 4 is a partially exploded cross sectional view of the ignition device of FIG. 1.

Referring now to FIG. 4, a cut away cross sectional view of the shell 6 of the ignitor with insulator 12 installed and placement of the crimp bushing 10 comprising an embodiment of the invention can be seen. The modified profile of the insulator 12, an embodiment, shows the major diameter or crimping boss 22, reduced in height to allow the maximization of opposing surface areas, inside and outside diameter, with a consistent wall thickness of the insulator. By increasing the opposing surface areas, greater capacitance can be achieved within a fixed footprint. The crimp bushing 10 constructed of a very mechanically strong material such as stainless steel or other steel derivative supplants the alumina removed from the crimping boss 22 to receive the shell crimp 47. More information on the crimp process can be gleaned further in this discussion.

Figure 5:
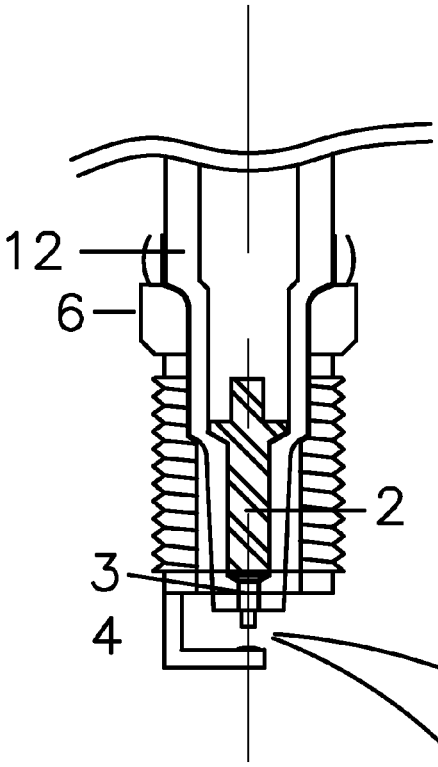
FIG. 5 is a fragmentary cross sectional view of the ignition device of FIG. 1.
Figure 5A:
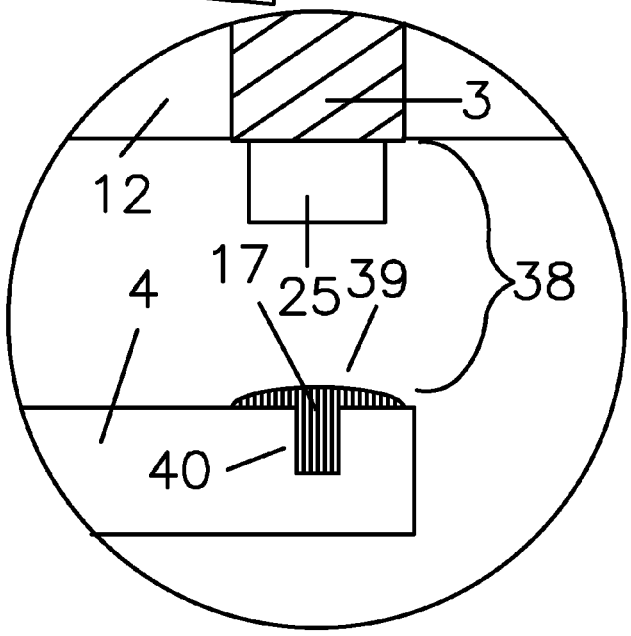
FIG. 5A is a view on an enlarged scale of an encircled area of FIG. 5.

Referring now to FIG. 5, a cross-sectioned cutaway of the lower section of the insulator 12 and shell 6, showing the center electrode 2, electrode tip 3, extension 25, ground electrode 4 and erosion resistant tip 17 thereon, and spark gap 38, is shown. It is well known to be desirable to maintain the spacing between the center electrode tip extension 25 and negative button 17, substantially constant over the life of the ignitor 1. This spacing is heretofore and hereinafter referred to as the spark gap 38. Accelerated erosion of the electrode tip extension 25 and ground electrode tip 17 due to high power discharge has previously been explained before herein as well as the mitigation thereof of erosion of the center electrode tip 3 and extension 25. The erosion resistant tip 17 of the negative electrode 4, in practice of the present invention, is preferred to be made in the shape of a button.

Said button having a continuous semi-spherical outer surface 39 the diameter thereof identical to the diameter of the opposing center electrode tip 3, being between about 1.0 mm and 1.5 mm height of the button is preferred to be in a ratio 1:10 to its diameter. The negative electrode tip 17 is preferred to have a cylindrical shank 40, a minimum of about 1.0 mm in diameter and about 0.75 mm in length, which is inserted into a hole drilled concentrically with the centerline axis of the insulator 12 into the ground electrode 4. The electrode tip 17 is attached to the ground electrode 4 by means of silver braze plasma welding or other typical means.

Figure 5B:
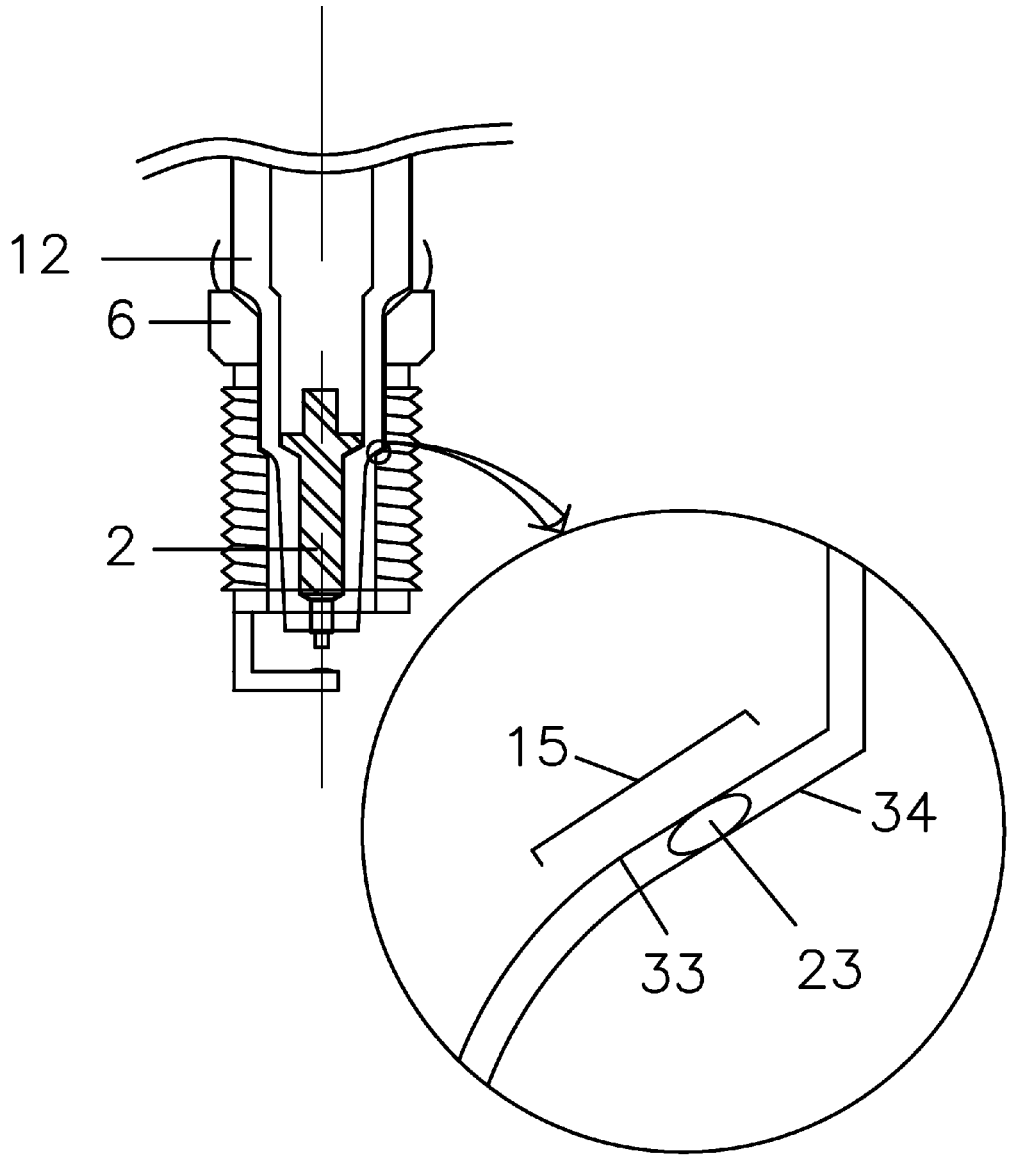
FIG. 5B is a view on an enlarged scale of another encircled area of FIG. 5.

Refer now to FIG. 5B, which is a cut away cross sectional view of the shell 6, insulator 12, and center electrode 2. In this view, highlight is made of the contact point of the leading angle 33 of the insulator 12 and the receiving angle 34 of the shell 6. At this contact area a washer constructed of nickel alloy or other highly conductive metal is positioned circumferentially around the insulator prior to installation of the insulator 12 into the shell 6. The standard industry practice of crimping the shell 6 onto the insulator 12 assures contact of the negative plate 36 of the capacitor as described herein above, to the shell 6.

During the crimping process, significant downward pressure, of about 8,000 to 10,000 lbs., is exerted on the shell compressing the washer 23 and forming a pressure seal against combustion gasses. The extreme pressures combined with the frictional forces created by the washer 23 during the crimping process at the leading angle 33 of the insulator 12 and the receiving angle 34 of the shell can remove the silver coating applied to the outside diameter of the insulator 12 creating the negative plate 36 of the capacitor. Losing the silver coating at this union would render the capacitor 11 inoperable, as it is at this juncture that the negative plate 34 is electrically connected to the ground circuit of the ignition through the shell 6.

To assure the silver coating is not lost during the crimping operation, special care is taken to apply a thicker layer of ink on the area of the leading angle 33 of the insulator 12 as shown at 15 during the application of the conductive ink on the outside diameter surface of the insulator 12 as described above. A minimum coating of about 0.005" of finished and molecularly bonded silver or silver platinum alloy is required at this juncture to assure proper grounding of the negative plate 34 to the shell 6 and an embodiment of the invention.

Figure 6:
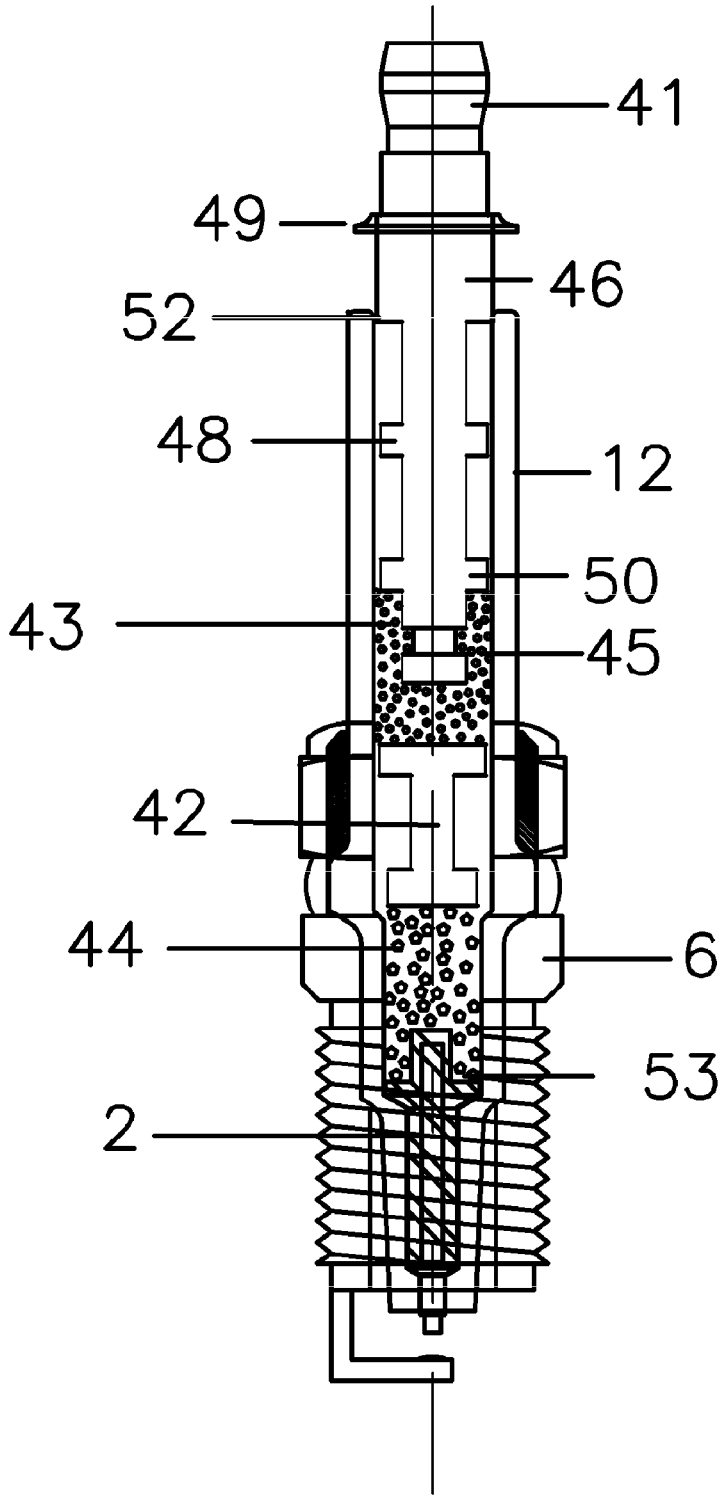
FIG. 6 is a cross sectional view of a partially assembled embodiment of an ignition device for internal combustion spark ignited engines of the present invention.

Looking now at FIG. 6, a cutaway cross section skeleton view of the assembled insulator with embodiments of the current invention prior to the high temperature press operation another embodiment of the current invention is shown.

During assembly of the insulator 12 the electrode 2 is placed in the insulator 12, followed by a fixed amount of copper/glass frit 44. The gas seal insert 42 is then inserted in the insulator 12 and pressed into the copper/glass frit 44. After compression, a fixed amount of carbon/glass frit or resistor frit 43 is measured and poured on top of the gas seal insert 42. The terminal 41 is then inserted into the insulator 12 and pressed into the carbon/glass frit 43 until the locking lug 45 is imbedded into the carbon/glass frit 43.

The assembled insulator is then heated to about 890° C. using a conventional form of heat such as, but not limited to, natural gas, infrared, or other source during a preferably sixteen minute cycle, removed quickly and the terminal 41 is pressed down until the terminal flange 49 rests atop the insulator 12.

The terminal 41 is preferably constructed of conductive steel plated with nickel and designed with a recessed locking lug 45 that provides electrical connection to the resistor frit 43 and positive engagement thereto eliminating the possibility of becoming loose during the lifetime of operation and compromising the operation of the ignitor 1. Further embodiments of the terminal 41 are the alignment boss 48, compression boss 50 and centering boss 46.

During installation of the terminal 41, the alignment boss 48 assures the terminal 41 remains in the center of the insulator during the cold and hot compression processes. The compression boss 50 of the terminal 4 is designed and provided to ensure very little if any molten carbon/glass frit bypasses the compression boss 50 ensuring compaction of both the molten carbon/glass frit 43 and the copper/glass frit 44.

During the high temperature compression of the terminal 41, the gas seal insert 42 is designed and provided to force molten copper/glass frit into the gas seal 53 directly atop the electrode 2 perfecting the seal against combustion pressures and gases. As well as perfecting the gas seal, the gas seal insert 42, is designed to force the molten copper/glass frit 43 up the interior sides of the insulator forming the positive plate of the capacitive element, best seen in FIG. 8.

The centering boss 46 is provided with a tapered end 52 easing the terminal 41 into the insulator 12 preventing damage to the insulator 12 during the hot compression process and ensuring the centering boss 47 proper entry into the insulator cavity.

Figure 7:
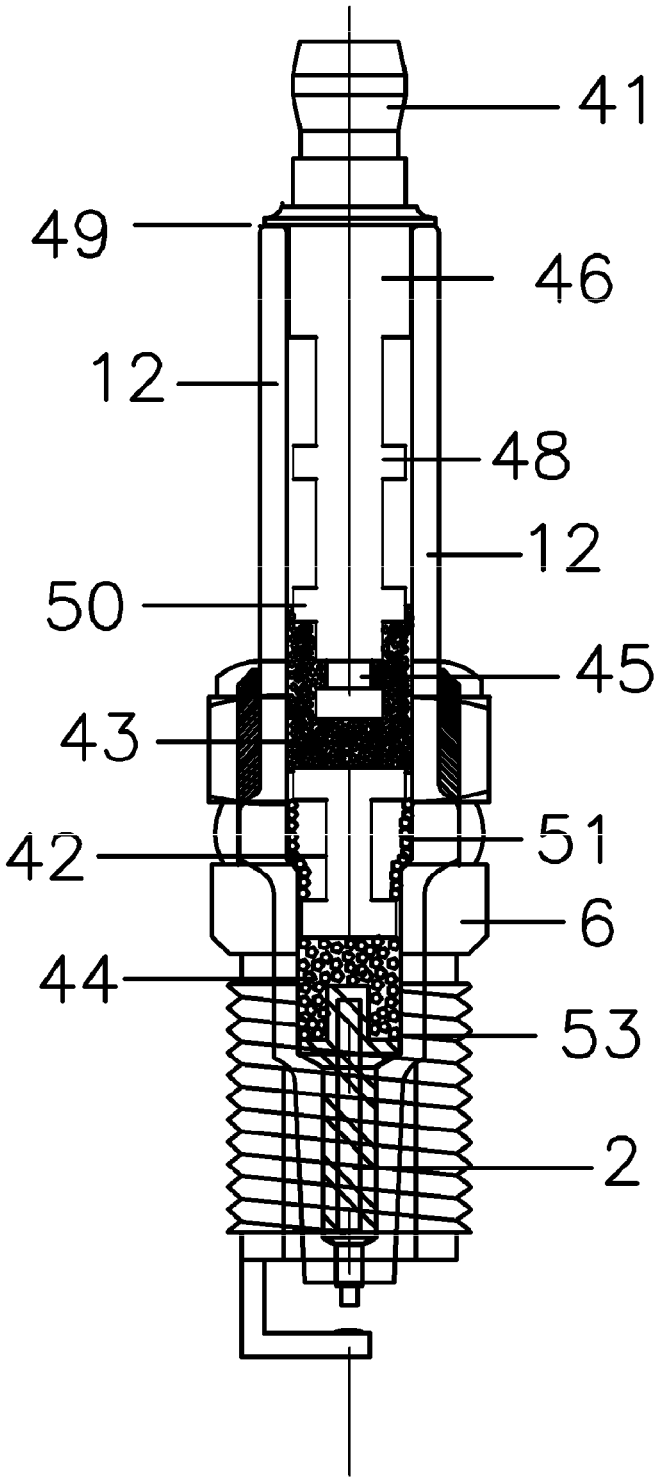
FIG. 7 is a cross sectional view of the ignition device of FIG. 6 shown assembled.

Referring to FIG. 7, a cutaway cross section skeleton view of an alternative method of creating the positive plate of the capacitive element, forming an internal gas seal, and fabricating a resistor of about 3-20 kohms which are the embodiments of the current invention can be seen. The insulator 12, shell 6, and electrode 2 remain the same as in the prior embodiments of the present invention. In this view the embodiments, terminal 41, gas seal insert 42, resistor frit 43, copper/glass frit 44 are provided and shown after the high temperature compression process.

The gas seal insert 42 of FIG. 6 is provided to ensure a proper gas seal 51 during the high temperature assembly. The requirement of gas seal insert 42 is dictated by the amount of copper/glass frit 44 and carbon/glass frit 43 used in the core assembly comprising the terminal 41, resistor 43, gas seal insert 42, copper/glass frit 44 and electrode 2. The design of the Terminal 41 and gas seal insert 42 must be such that when utilized in conjunction with the proper amounts of carbon/glass frit 44 and copper/glass frit 43, the processed assembly yields the correct resistance of $3K_{\Omega}$-$20K_{\Omega}$ and capacitance of 20 pf-100 pf with a perfected gas seal 53.

Shown in FIG. 7 is the formed positive plate 51, an embodiment of the current invention, of the capacitive element of the ignitor. The plate 51 is formed when the gas seal insert 42 is compressed by the terminal 41 during the high temperature compression process.

Although the invention has been described in detail with particular reference to these preferred embodiments, other embodiments can achieve the same results. Variations and modifications of the present invention will be obvious to those skilled in the art and it is intended to cover all such modifications and equivalents. The entire disclosures of all references, applications, patents, and publications cited above and/or in the attachments, and of the corresponding application(s), are hereby incorporated by reference.

What is claimed is:

1. A high power discharge ignition device for an internal combustion engine, comprising:

an insulator having an upper end and a lower end and defining a cavity therein, said insulator including an outside diameter and an inside diameter and comprising an alumina material;

a first conductor bonded to at least a portion of said inside diameter of said insulator body;

a second conductor bonded to at least a portion of said outside diameter of said insulator body, said first conductor, said second conductor, and said insulator forming a capacitor wherein at least one of said first conductor or said second conductor comprises a conductive ink;

a tip assembly disposed in said cavity of said insulator, said tip assembly comprising a positive electrode tip;

a resistor member disposed in said cavity and connected to said tip assembly, said resistor member comprising a resistor frit material;

an electrical connector coupled to said resistor member; and a shell attached to said second conductor, said shell including a negative electrode having a tip formed thereon and spaced apart from said positive electrode tip.

2. The device of claim 1 wherein said resistor member comprises a resistor and spring assembly.

3. The device of claim 1 wherein said resistor frit material comprises a carbon and glass compound material.

4. The device of claim 1 further comprising a second frit material disposed in said cavity and connected to said tip assembly and said resistor frit material.

5. The device of claim 4 wherein said second frit material comprises a copper alloy, said copper alloy sealing said lower end of said insulator.

6. The device of claim 4 wherein said resistor frit material is coupled to said second frit material by a gas seal insert member.

7. The device of claim 1 wherein said first conductor comprises a silver ink.

8. The device of claim 1 wherein said second conductor comprises a precious metal alloy.

9. The device of claim 1 wherein said second conductor comprises a coating of silver conductive ink, said coating having a predetermined thickness.

10. The device of claim 1 wherein said alumina material comprises from about 80 percent to about 99 percent pure alumina.

11. The device of claim 1 wherein said positive and negative electrode tips comprise a sintered rhenium and molybdenum material.

12. The device of claim 11 wherein said material is formed from about at least 50 percent rhenium and at most about 50 percent molybdenum.

13. The device of claim 11 wherein said material is formed from about 75 percent rhenium and about 25 percent molybdenum.

14. The device of claim 1 wherein said capacitor has a predetermined capacitance in the range from about 30 to about 100 pf.

15. The device of claim 1 wherein said tip assembly is attached to said first conductor by a silver paste, said silver paste sealing said lower end of said insulator.

16. The device of claim 1 wherein said tip assembly is connected to said first conductor, said positive electrode tip extending from said insulator, said tip assembly sealing said lower end of said insulator.

17. The device of claim 1 wherein said electrical connector seals said upper end of said insulator.

* * * * *